United States Patent [19]

Johnson

[11] 4,435,693

[45] Mar. 6, 1984

[54] ELECTRICAL INSULATING REFRACTORY COMPOSITION

[75] Inventor: Walter R. Johnson, Chuckey, Tenn.

[73] Assignee: Combustion Engineering, Inc., Windsor, Conn.

[21] Appl. No.: 385,343

[22] Filed: Jun. 7, 1982

[51] Int. Cl.[3] ..... H01C 1/03

[52] U.S. Cl. ..... 338/238; 106/306; 174/102 P; 219/544; 501/104; 501/118; 501/119; 501/122

[58] Field of Search ..... 174/102 P; 501/118, 501/122, 128, 129, 108, 104, 135; 106/306; 338/238; 423/635; 219/544

[56] References Cited

U.S. PATENT DOCUMENTS

| | | | |
|---|---|---|---|
| 3,459,567 | 8/1969 | Yamamoto et al. | 501/135 |
| 3,583,919 | 6/1971 | Balint et al. | 501/122 |
| 3,682,828 | 8/1972 | Keddeinis et al. | 338/238 X |
| 4,331,773 | 5/1982 | Hongo et al. | 501/128 |

FOREIGN PATENT DOCUMENTS

| | | | |
|---|---|---|---|
| 52-7579 | 3/1977 | Japan | 338/238 |
| 56-4033 | 1/1981 | Japan | 338/238 |

*Primary Examiner*—Helen M. McCarthy
*Attorney, Agent, or Firm*—Richard H. Berneike

[57] ABSTRACT

Sheathed electrical heating elements containing MgO heat conductive, electrical insulating material having a high degree of calcination together with additives in the form of a clay and fumed silica to increase the electrical resistivity, density and flow properties.

3 Claims, No Drawings

ELECTRICAL INSULATING REFRACTORY COMPOSITION

BACKGROUND OF THE INVENTION

This invention relates to sheathed electrical heating elements and more particularly to an electrical insulating refractory composition for use therein.

Sheathed electrical heating elements are used extensively in many heating applications. These elements consist of a metal sheath, an electrical heating element located within the sheath and an electrical insulating material embedding the heating element within the sheath. Generally, the embedding material is fused magnesium oxide which has excellent thermal conductivity while maintaining high electrical resistivity.

The high temperatures which are reached in such heating elements, their continued use over a long period of time, and the thermal cycling tends to degrade the insulating materials. For this reason, many different combinations of materials have been investigated with varying degrees of success. The object is to form an embedding composition which will be stable over a wide range of temperatures both as to electrical resistivity and thermal conductivity. Although there are materials which can be added to the magnesium oxide which will enhance these properties, there are other factors to be taken into consideration. More specifically, the embedding material must be able to be vibrated or tapped to a relatively dense material prior to compaction. This property is referred to as the "tap density" and it is measured by the ASTM Procedure No. 3347-74. The other property which is effected by additives is the flowability of the embedding material powder. It is necessary that adequate flowability be maintained so that the powder will flow through the machines which are normally used by the heating element industry. The current technique employed for manufacture of electrically insulating magnesium oxide powders includes grinding and sizing which reduces the magnesium oxide particle size dimension such that all particles will pass a U.S. Standard 40 mesh sieve (0.0165 inches). The particles are then polished by standard process which will increase the tap density of the powder. This is followed by calcining which increases the electrical resistivity.

Calcining is accomplished by heating the magnesium oxide powder to a temperature in excess of 1200° C. Electrical resistivity is increased by the calcining process wherein oxygen deficiencies of the magnesium oxide crystal lattice are satisfied and oxidation of various impurity phases is completed. Because of the tendency to sinter at temperatures above 1100° C., magnesium oxide powder loses a portion of its ability to flow and suffers a reduction in tap density because of the calcining process. These latter properties may be reduced to unacceptable levels during the calcining. Therefore, it is necessary to make a compromise with respect to the calcining process such that increased electrical resistivity can be obtained without overly reducing the tap density and flowability. This means that the maintenance of adequate tap density and flowability requires that electrical resistivity be accepted which is lower than the potential maximum.

SUMMARY OF THE INVENTION

The present invention relates to magnesium oxide heat conductive electrical insulating compositions and to sheathed electrical heating elements in which the compositions are used. More particularly, the composition is an MgO material which has a high degree of calcination with the resultant high electrical resistivity together with additives in the form of a clay and fumed silica which will increase the electrical resistivity and maintain tap density and flow properties.

DESCRIPTION OF THE PREFERRED EMBODIMENT

It has been known in the past that the electrical resistivity and thermal conductivity of MgO electrical insulating materials can be increased by the use of minor amounts of various clay additions. For examples, see U.S. Pat. No. 3,583,919. The problem that arises from such clay additives is that they reduce the flow properties of the mixtures. This tends to make such mixtures impractical for use in the filling machines normally used by the heating element industry.

The present invention involves the use of clay additives such as have been used in the past with the differences being that they are used in very pure form (low in sodium, potassium, lithium and other soluble salts) and that they are used in combination with fumed silica. The purity of the clay means that very small amounts can be used to obtain the same degree of enhancement of the electrical and thermal properties. The fumed silica (as opposed to other forms of silica) restores or enhances the flow properties as well as enhancing the electrical properties.

The preferred clay additive for the present invention is kaolin, a clay having kaolinite as its chief constituent. The soluble salt content is preferably less than 0.5% by weight.

Fumed silica is a colloidal form of silica made by the combustion of silicon tetrachloride in hydrogen-oxygen furnaces. It is very fine white powder precipitated from the fumed state and has a particle size of about 0.2 to 0.7 micron. When this form of silica is added along with the clay, the flow properties are increased to acceptable levels. The following table illustrates the invention:

| INGREDIENT | % RANGE |
|---|---|
| MgO | 97.0–99.97 |
| Kaolin | 0.025–2.0 |
| Fumed Silica | 0.005–1.0 |

The effect of the present invention on the properties is illustrated by the following tables in which Table I is the MgO without any additives and Table II is the MgO with 0.025% fumed silica and 0.05% kaolin:

TABLE I

| Sample No. | Density ($g/cm^3$) | Static Flow (gm) | Megohms |
|---|---|---|---|
| 1 | 2.36 | 40.2 | 2.65 |
| 2 | 2.35 | 35.5 | 2.65 |
| 3 | 2.36 | 32.3 | 2.7 |
| 4 | 2.355 | 34.4 | 2.7 |
| 5 | 2.36 | 32.3 | 3.2 |
| 6 | 2.36 | 41.9 | 3.3 |
| 7 | 2.365 | 42.8 | 4.5 |
| 8 | 2.365 | 45.6 | 3.85 |
| 9 | 2.355 | 39.1 | 4.15 |
| 10 | 2.36 | 30.3 | 4.3 |
| Average | 2.359 | 37.4 | 3.4 |

TABLE II

| Sample No. | Density ($g/cm^3$) | Static Flow (gm) | Megohms |
|---|---|---|---|
| 1 | 2.39 | 51.1 | 6.5 |
| 2 | 2.385 | 49.6 | 6.6 |
| 3 | 2.39 | 45.0 | 7.75 |
| 4 | 2.39 | 53.8 | 8.0 |
| 5 | 2.40 | 50.0 | 7.7 |
| 6 | 2.395 | 53.1 | 5.85 |
| 7 | 2.40 | 50.2 | 7.6 |
| 8 | 2.385 | 51.2 | 7.5 |
| 9 | 2.39 | 49.4 | 7.05 |
| 10 | 2.395 | 48.2 | 7.4 |
| Average | 2.392 | 50.2 | 7.2 |
| % Increase | 1.40 | 34.2 | 112 |

Electrical resistivity values expressed as megohm-inches were measured at 885° C. after the heating element in which they were incorporated had been maintained at that temperature for 2 hours. Increasing electrical resistivity is synonymous with increasing quality. Density was determined by ASTM Standard Test Method for Flow Rate and Tap Density of Electrical Grade Magnesium Oxide, ASTM Designation No. 3347-74. Static flow, which is indicative of angle of repose, was determined by weighing that quantity of powder which will flow from a one quarter inch orifice located at the bottom center of a one-inch deep bed of the powder mixture. The values for static flow expressed herein including the claims are defined as having been derived by this method. Increasing static flow is synonymous with increasing quality. It is clear from these Tables that the addition of the combination of clay and fumed silica will greatly increase the resistivity while maintaining the density and significantly increasing the flow properties.

I claim:

1. A MgO heat conductive electrical insulating embedding composition for sheathing electrical heating elements and having a density of at least 2.385 $g/cm^3$, a static flow at least 45.0 g, and an electrical resistivity of at least 5.85 Megohm-inches measured after two hours at 885° C. consisting essentially of in admixture:

a. from 97.0 to 99.97 weight % MgO, said MgO being minus 40 mesh and having been calcined at a temperature in excess of 1200° C.;

b. from 0.025 to 2.0 weight % of a clay having a soluble salt content less than 0.5% by weight; and c. from 0.005 to 1.0 weight % fumed silica having a particle size of from 0.2 to 0.7 microns.

2. A sheathed electrical heating element comprising an electrical resistance element, a metal sheath surrounding said electrical resistance element and an improved heat conductive electrical insulating composition embedding said electrical resistance element within said sheath consisting of the composition of claim 1.

3. A MgO heat conductive electrical insulating embedding composition as recited in claim 1 wherein said clay is kaolin.

* * * * *